US006105344A

United States Patent [19]

Maeda et al.

[11] Patent Number: 6,105,344

[45] Date of Patent: Aug. 22, 2000

[54] BAND LOADING DEVICE FOR A PACKING MACHINE

[75] Inventors: Kouya Maeda; Norio Okazawa, both of Chiba, Japan

[73] Assignee: Naigai Ltd., Sanbu-gun, Japan

[21] Appl. No.: 09/182,891

[22] Filed: Oct. 30, 1998

[30] Foreign Application Priority Data

Mar. 23, 1998 [JP] Japan ..... 10-94101

[51] Int. Cl.[7] ..... B65B 13/04

[52] U.S. Cl. ..... 53/589; 100/26

[58] Field of Search ..... 53/589; 100/25, 100/26, 32

[56] References Cited

U.S. PATENT DOCUMENTS 4,271,655 6/1981 Nagayoshi ..... 53/589 X 5,299,407 4/1994 Schuttler et al. ..... 53/589 X

FOREIGN PATENT DOCUMENTS 1-52242 11/1989 Japan .

*Primary Examiner*—Linda Johnson

*Attorney, Agent, or Firm*—Oblon, Spivak, McClelland, Maier & Neustadt, P.C.

[57] ABSTRACT

A reel holder for rotatably holding a band reel in a vertical position on one side of a pool box. A relay roller for relaying the band pulled out from the reel holder to a pair of pre-feed rollers is also provided. The pair of pre-feed rollers is arranged above the relay roller. The nip of the pair of pre-feed rollers is positioned in the same plane as the pool box of a packing machine. Each axis of the pair of pre-feed rollers is inclined so that the nip of the pair of pre-feed rollers inclines in an opposite direction of the reel holder. Accordingly, a band loading operation can be easily executed. The pair of pre-feed rollers is preferably arranged adjacent to a working table of the packing machine, i.e., above the pool box so that an operator does not have to crouch during the band loading operation.

8 Claims, 6 Drawing Sheets

BAND LOADING DEVICE FOR A PACKING MACHINE

BACKGROUND OF THE INVENTION

1. Field of the Invention

The present invention relates generally to a band loading device for a packing machine and more particularly to a band loading device which is capable of directly inserting a band into a pair of pre-feed rollers, which is positioned adjacent to an inlet of a pool box, from a band reel provided in a packing machine.

2. Discussion of the Background

Generally, a band guide arch, a sealer unit, a band forward-reverse unit and pool box of a packing machine are arranged in the same plane. An inlet of the pool box and a pair of pre-feed rollers for supplying a band into the pool box are also arranged in the plane of these elements.

A band reel which holds the band and supplies the band to the packing machine is preferably accommodated in the packing machine for safety and to save space. However, it is preferable not to decrease the capacity of the pool box by the band reel. Thus, the band reel is generally arranged at one side of the pool box in the packing machine. That is, the band reel is usually arranged in front of the pool box or behind the pool box in the packing machine.

With this arrangement, however, the band must be twisted at the pre-feed rollers since the band path from the band reel to the pool box is not in the same vertical surface. Thus, the twist of the band should be corrected. Japanese Patent Publication No. Hei 1-52242 discloses one solution for re-twisting the band. That is, as shown in FIG. 4 of Japanese Patent Publication No. Hei 1-52242, a band guide structure is provided in the packing machine. The band guide structure comprises a relay roller rotatably attached on a fixed stand below the band reel and two rollers for turning the direction of the band above the relay roller. The band pulled out from the band reel is relayed by the relay roller. Then, the band is wound by the two rollers in reverse U-shape, so that the twist of the band is corrected at the pre-feed rollers disposed adjacent to the bottom of the pool box. The wound form of the band is also changed.

However, the packing machine disclosed in Japanese Patent Publication No. Hei 1-52242 has some disadvantages. That is, the pre-feed rollers are positioned adjacent to the bottom of the pool box. Thus, the inserting operation of the band into a nip of the pre-feed rollers is not easily executed. The band guide structure can not be formed compactly. Thus, the band guide structure makes the packing machine large. It is not easy to set the band in the band guide structure because the band must be twisted between two rollers, so this operation is not easily executed. High skill is necessary to set the band. Especially, trouble will occur during the packing operation if the band is not correctly set. In this case, the packing operation will be decreased in efficiency.

SUMMARY OF THE INVENTION

Accordingly, an object of the present invention is to provide a band loading device for a packing machine, which is capable of directly inserting a band from a band reel into a band inlet without using a band guiding structure.

Another object of the present invention is to provide a band loading devise for a packing machine which is capable of providing a band inlet at a high position, so that an operator can stand when inserting the band into the inlet.

These and further objects of the present invention are achieved by the novel band loading device for a packing machine of the present invention. According to the novel band loading device for a packing machine of the present invention, a reel holder for rotatably holding a band reel in vertical position is provided on one side of a pool box. A relay roller for relaying the band from the reel holder to a pair of pre-feed rollers is also provided. The pair of pre-feed rollers is arranged above the relay roller. A nip of the pair of pre-feed rollers is positioned in the plane of a pool box of a packing machine. Each axis of said pair of pre-feed rollers is inclined so that the nip of the pair of pre-feed rollers inclines in an opposite direction to that of the reel holder. Accordingly, the operation of loading the band in the nip of the pre-feed rollers is easily executed. In another aspect of the present invention, a guide roller for guiding the band from the relay roller to the pair of pre-feed rollers is provided. The axis of the guide roller is inclined in an opposite direction to that of the reel holder, so that it is not necessary to incline the pair of pre-feed rollers.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, in which.

DESCRIPTION OF THE PREFERRED EMBODIMENTS

The preferred embodiment of the present invention is now explained with reference to FIGS. 1 to 11.

Figure 1:
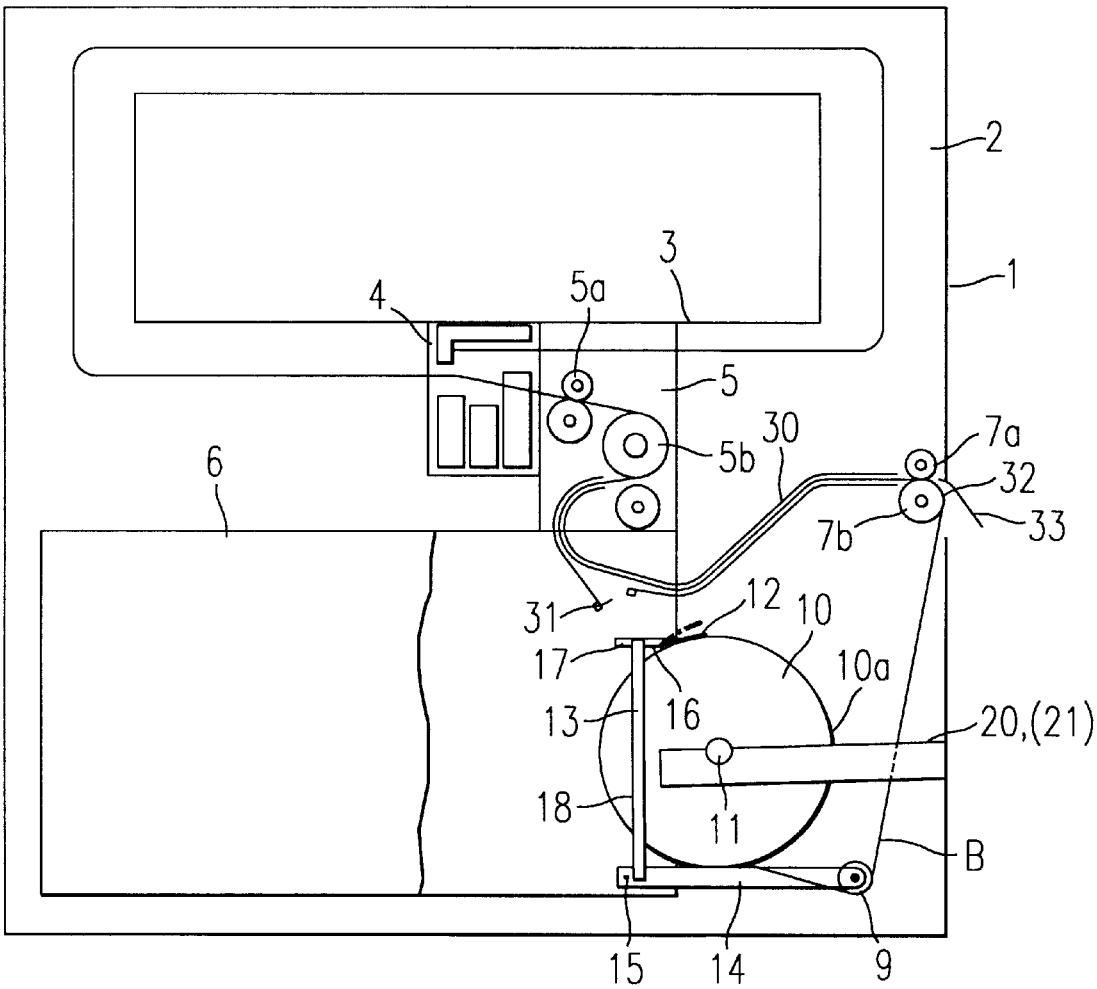
FIG. 1 is a sectional elevation showing a packing machine, which uses a band loading device of the present invention.

FIG. 1 is a sectional elevation showing one embodiment of the present invention. A band reel 10 is arranged in front of a pool box 6. In FIG. 1, 1 is designated as a packing machine. 2 is designated as a band guide arch. 3 is designated as a working table. 4 is designated as a sealer unit. 5 is designated as a band forward-reverse unit. 6 is designated as a pool box. 7 is designated as a pair of pre-feed rollers. 9 is designated as a relay roller having a barrel-like shape.

10 is designated as a band reel. 11 is designated as a rotating axis of the band reel 10. 12 is designated as a brake pad being capable of being urged against a side fence 10*a* of the band reel 10. The brake pad 12 is connected with the relay roller 9 through an interlocking mechanism 13.

Several types of the band reel 10 can be used. That is, a band reel cassette type, which pre-accommodates a band coil between two opposite band reel plates having an axis, can be used. A fixed axis type, which holds the band on a drum or a boss fixedly inserted into the fixed axis fixed to a frame, can be used. In this embodiment, the band reel cassette type is used.

Figure 2:
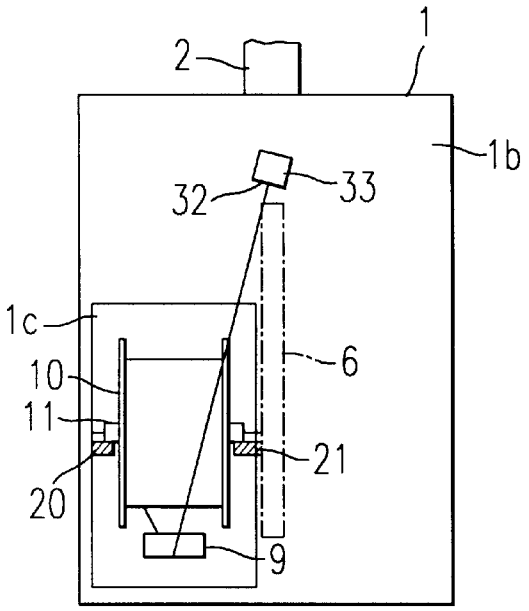
FIG. 2 is a side elevation showing the band loading device of the present invention.
Figure 3:
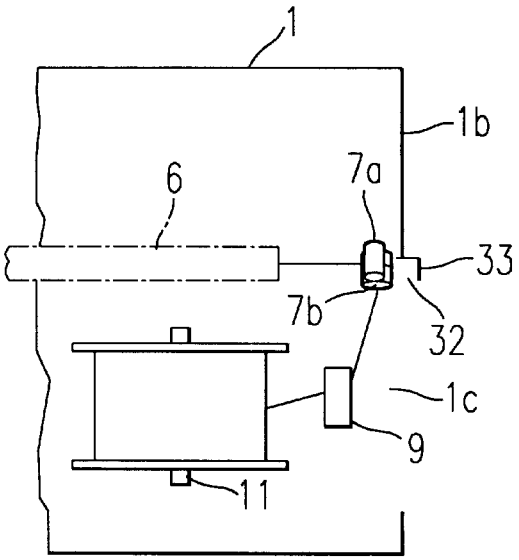
FIG. 3 is a plan view showing the band loading device of the present invention.
Figure 6:
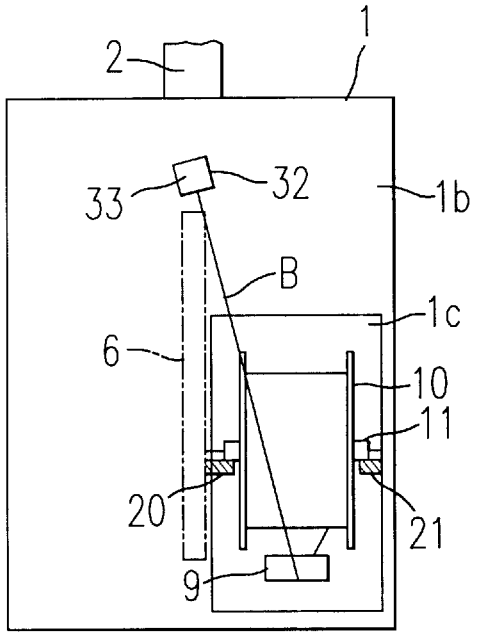
FIG. 6 is a side elevation showing the band loading device of a first variation of the present invention.
Figure 7:
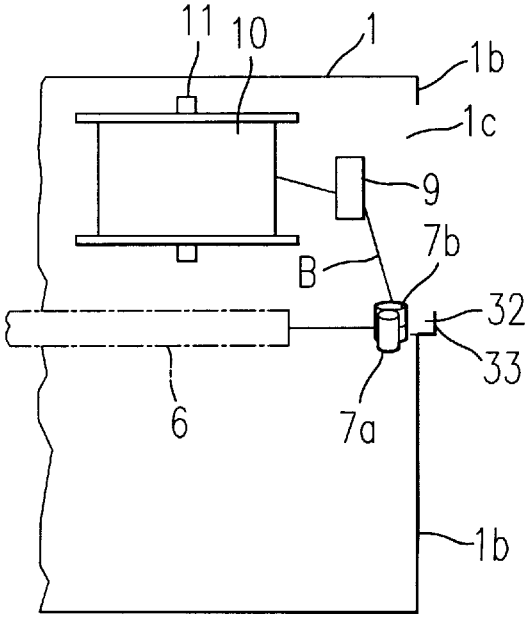
FIG. 7 is a plan view showing a band loading device of a first variation of the present invention.

20, 21 are designated as reel holders for holding the cassette of the band reel 10. The reel holders 20, 21 hold the band reel 10 so that the rotating axis 11 of the band 10 is allowed to slip. The reel holders 20, 21 also operate as bearings for the rotating axis 11 of the band reel 10. In one variation, as shown in FIGS. 6 and 7, the band reel 10 may be positioned behind the pool box 6. In another variation, as shown in FIGS. 2 and 3, the band reel 10 is positioned in front of the pool box 6. Thus, the band reel 10 can be inserted and removed from a side opening 1*c* provided in a side plate 1*b* of the packing machine 1.

The interlocking mechanism 13 is a parallel link mechanism having a pair of levers 14, 16 pivotally attached by a pair of pivots 15, 17 respectively. The pair of levers 14, 16 are connected with a link 18. The relay roller 9 is pivotally attached to an end of the lever 14. The brake pad 12 is attached to an end of the lever 16. The relay roller 9 operate as a dancer roller under the tension of the band B during the band pulling operation. Accordingly, the brake pad 12 does not brake the band reel 10 when the tension of the band B acts on the relay roller 9. The brake pad 12 brakes the band reel 12 when the tension of the band B does not act on the relay roller 9. This is because the weight of the relay roller 9 acts on the brake pad 12 via the pair of levers 14, 16 and the link 18.

Figure 4:
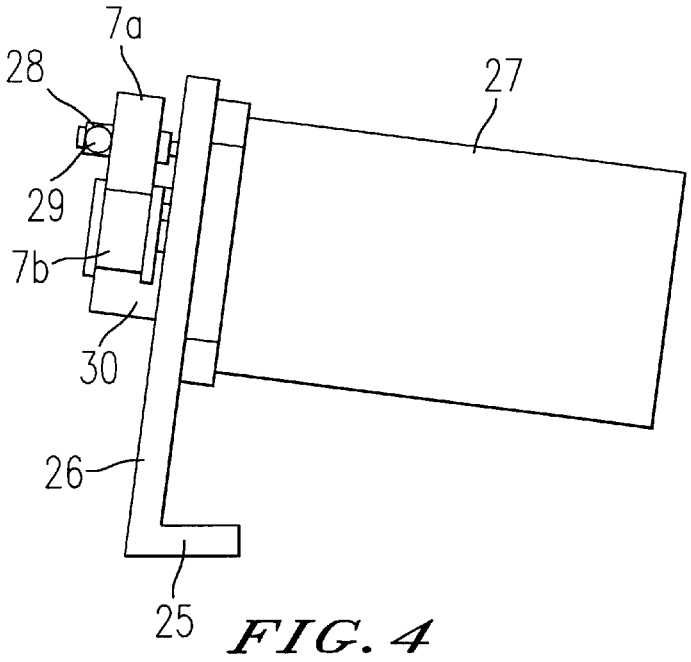
FIG. 4 is a side elevation showing a pair of pre-feed rollers and a motor thereof of the present invention.
Figure 5:
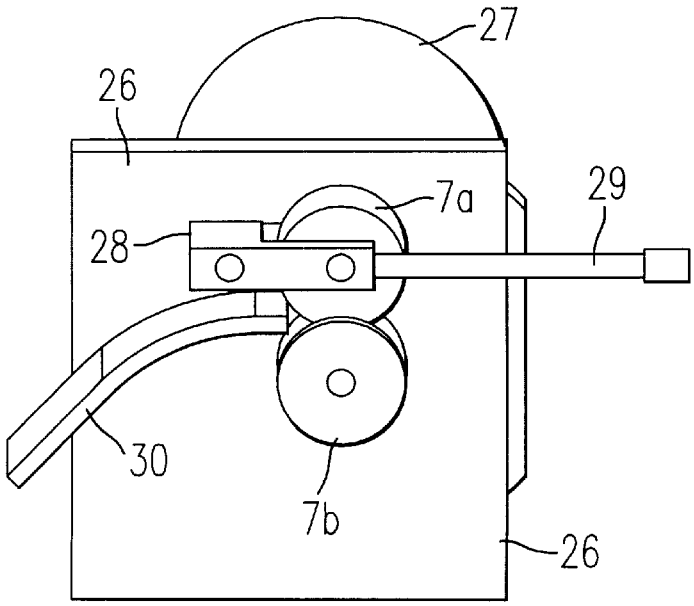
FIG. 5 is a perspective view showing the pair of pre-feed rollers and the motor thereof of the present invention.

As shown in FIGS. 4 and 5, the pair of pre-feed rollers 7 comprises a driving roller 7*b* directly connected to an axis of a motor 27, and a pressure roller 7*a* urged against the driving roller 7*b*. The driving roller 7*b* has a pair of flanges at both ends thereof. The pair of pre-feed rollers 7 is positioned above the relay roller 9. The nip of the pair of pre-feed rollers 7 is positioned in the same plane as the pool box 6 as shown in FIGS. 2 and 3. Each axis of the pair of pre-feed rollers 7 are inclined so that the nip of the pair of pre-feed rollers 7 inclines in a opposite direction to that of the reel holder 10.

25 is designated as a frame. 26 is designated as an inclined support plate. 27 is designated as the motor. 28 is designated as a pressure mechanism which applies pressure to the pressure roller 7*a*. The pressure mechanism 28 has a manual lever 29 for separating the pressure roller 7*a* from the driving roller 7*b*. In the present invention, the position of the driving roller 7*b* and the pressure roller 7*a* is not limited to this embodiment. The driving roller 7*b* may be positioned on the pressure roller 7*a*.

As shown in FIG. 2, the inlet 32 of the pool box 6 is provided on the side plate 1*b*. The inlet 32 is inclined corresponding to the nip of the pair of pre-feed rollers 7. 33 is designated as a guide plate for guiding the band B. 30 is designated as a band guide path connected with the nip of the pair of pre-feed rollers 7. The band guide path 30 is formed by two parallel plates. As shown in FIG. 5, the band guide path 30 is curved in a section connected to the pair of pre-feed rollers 7 so as to correspond to the inclination of the nip of the pair of pre-feed rollers 7. The band guide path 30 is connected to the pool box 6 in a middle portion and to a reverse roller 5*b* of the band forward-reverse unit 5 in an end portion. 31 is designated as a band inlet for receiving the band B into the pool box 6 and removing the band B from the pool box 6. The band inlet 31 may be formed at in the horizontal portion or inclined portion of the pool box 6.

In operation, the band B is pulled out from the band reel 10. The band B from the band reel 10 can be handled from only one side of the packing machine 1. That is, as shown in FIG. 2, the band B can be pulled out from the side opening 1*c*. The pulled out band B is placed around the relay roller 9 via the inlet 32.

Once the driving roller 7*b* of the pair of pre-feed rollers 7 is driven after inserting the band B into the nip of the pair of pre-feed rollers 7, the band B will be fed by the pair of pre-feed rollers 7. Then, the band B is guided into the band guide path 30, so that the band B is set on the band guide arch 2 through the band forward-reverse unit 5. The manual lever 29 insures that the band B is pinched between the driving roller 7*b* and the pressure roller 7*a*. The manual lever 29 is not shown in FIGS. 2 and 3. While the band B is fed by the pair of pre-feed rollers 7, the band B is under tension. Thus, the brake pad 12 does not brake the band reel 10 since the tension of the band B acts on the relay roller 9, so that the band reel 10 can freely rotate. The pulled out band B is held in the pool box 6, then waits for supply.

As mentioned above, the band reel 10 can be positioned behind the pool box 6 as shown in FIGS. 6 and 7. In this embodiment, the direction of inclination with respect to the nip of the pair of pre-feed rollers 7 is opposite to that shown in FIGS. 1 to 5.

Figure 8:
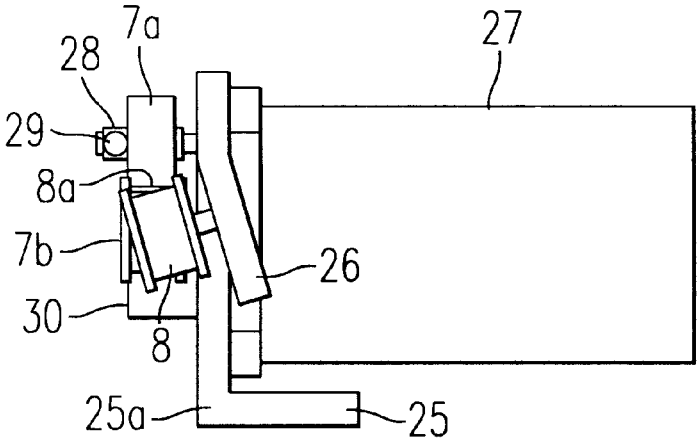
FIG. 8 is a side elevation showing the pair of pre-feed rollers, the motor thereof and a guide roller of a second variation of the present invention.
Figure 9:
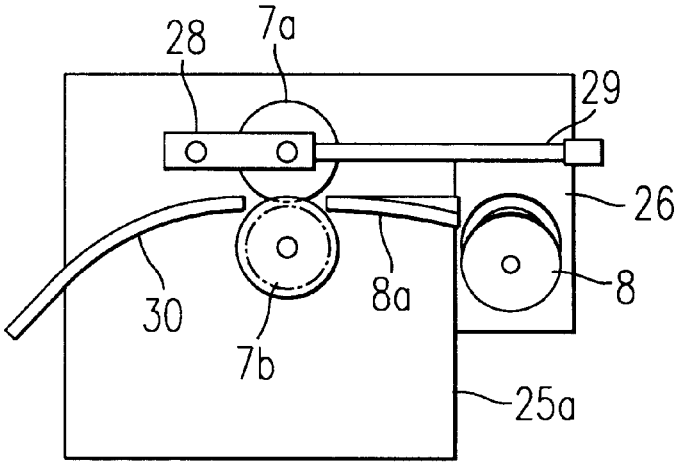
FIG. 9 is a perspective view showing the pair of pre-feed rollers, the motor thereof and the guide roller of a second variation of the present invention.

As shown in FIGS. 8 and 9, the inclination of the nip of the pair of pre-feed rollers 7 can be replaced with a guide roller 8 that is inclined. The guide roller 8 is provided between the pair of pre-feed rollers 7 and the inlet 32. The guide roller 8 has a flange at each end thereof. In this embodiment, the axes of the pre-feed rollers 7 are arranged horizontally. As shown in FIG. 8, the motor 27 is fixed to the vertical portion 25*a* of the frame 25 with the pre-feed rollers 7. As shown in FIG. 9, a guide plate 8*a* is provided between the pre-feed rollers 7 and the guide roller 8.

Figure 10:
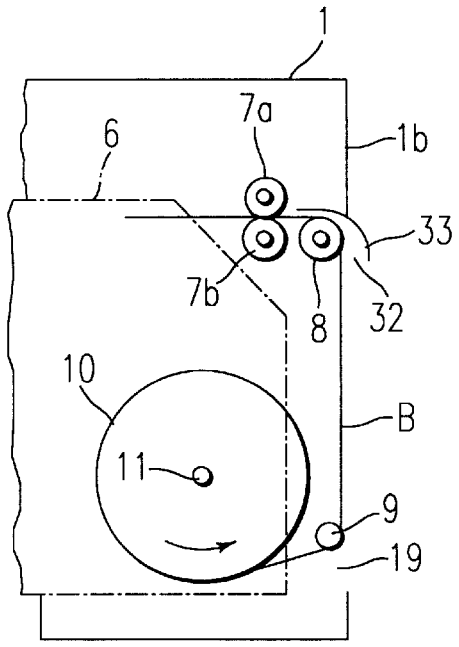
FIG. 10 is an elevation showing one example of setting a band to the band loading device of the present invention.
Figure 11:
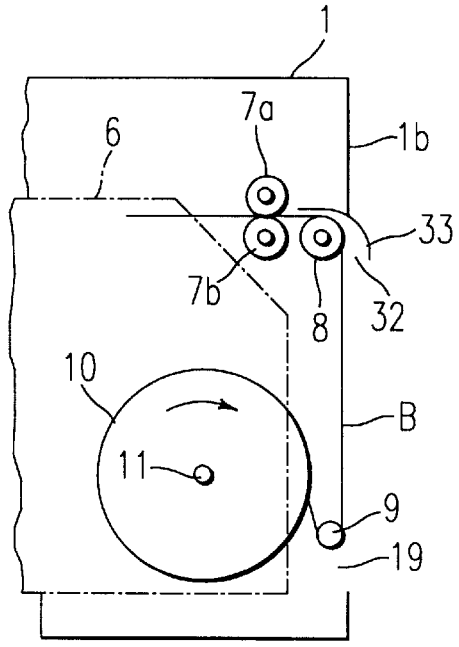
FIG. 11 is an elevation showing another example of setting the band to the band loading device of the present invention.

As shown in FIG. 10, the band B may be pulled out from the lower portion of the band reel 10. As shown in FIG. 11, the band B may be pulled out from upper portion of the band reel 10. The direction of pulling out the band B is not limited in the present invention. The wound form of the band B can be changed if the band B is pulled out as shown in FIG. 11.

The present invention may be embodied in other specific forms without departing from the spirit or essential characteristics thereof. The present embodiment is therefore to be considered in all respects as illustrative and not restrictive, the scope of the present invention being indicated by the appended claims rather than by the foregoing description and all changes which come within the meaning and range of equivalency of the claims are therefore intended to be embraced therein.

The present application is based on Japanese Priority Document 10-94101 filed on Mar. 23, 1998, the content of which is incorporated herein by reference.

What is claimed is:

1. A band loading device for a packing machine containing a pool box, comprising:

a reel holder rotatably holding a band reel for winding a band in a vertical position, said reel holder being contained in a packing machine and provided on one side of a pool box;

a rotatable relay roller for relaying said band pulled out from said reel holder, said relay roller being arranged adjacent to outside of said packing machine against said reel holder; and a pair of pre-feed rollers for supplying said band into said packing machine directing to said pool box at a position above said relay roller with respect to said packing machine, a nip of said pair of pre-feed rollers being positioned in a same plane as said pool box, each axis of said pair of pre-feed rollers being inclined so that the nip of said pair of pre-feed rollers inclines in an opposite direction of said reel holder.

2. A band loading device for a packing machine according to claim 1, wherein one of said pre-feed rollers is driven, said driven pre-feed roller having a flange at each end thereof.

3. A band loading device for a packing machine according to claim 1, wherein said relay roller is a dancer roller.

4. A band loading device for a packing machine according to claim 1, further comprising a brake equipment interlocked with said relay roller so as to selectively brake said band reel in response to a movement of said relay roller, wherein said brake equipment does not brake said band reel when a tension of said band acts on said relay roller, and said brake equipment brakes said band reel when a tension of said band does not act on said relay roller.

5. A band loading device for a packing machine containing a pool box, comprising:

a reel holder rotatably holding a band reel for winding a band in a vertical position, said reel holder being contained in a packing machine and provided on one side of a pool box;

a relay roller for relaying said band pulled out from said reel holder, said relay roller being arranged adjacent to outside of said packing machine against said reel holder;

a pair of pre-feed rollers for supplying said band into said packing machine directing to said pool box at a position above said relay roller with respect to said packing machine, a nip of said pair of pre-feed rollers being positioned in a same plane as said pool box; and a guide roller for guiding said band from said relay roller to said pair of pre-feed rollers, an axis of said guide roller being inclined in an opposite direction of said reel holder.

6. A band loading device for a packing machine according to claim 5, wherein one of said pre-feed rollers is driven, said driven pre-feed roller having a flange at each end thereof.

7. A band loading device for a packing machine according to claim 5, wherein said relay roller is a dancer roller.

8. A band loading device for a packing machine according to claim 5, further comprising a brake equipment interlocked with said relay roller so as to selectively brake said band reel in response to a movement of said relay roller, wherein said brake equipment does not brake said band reel when a tension of said band acts on said relay roller, and said brake equipment brakes said band reel when a tension of said band does not act on said relay roller.

* * * * *